US006416146B1

(12) United States Patent
Chua et al.

(10) Patent No.: US 6,416,146 B1
(45) **Date of Patent: *Jul. 9, 2002**

(54) APPARATUS FOR CONTROLLING PEN-TO-PRINT MEDIUM SPACING

(75) Inventors: Ching Yong Chua; Pui Wen Huang; Kok Sam Yip, all of Singapore (SG)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/477,770

(22) Filed: Jan. 4, 2000

(51) Int. Cl.[7] ..... B41J 25/308
(52) U.S. Cl. ..... 347/8; 400/56
(58) Field of Search ..... 347/8; 400/55, 400/56, 57, 58, 59, 60

(56) References Cited

U.S. PATENT DOCUMENTS 4,883,375 A * 11/1989 Karube et al. ..... 400/55
4,932,797 A * 6/1990 Emenaker et al. ..... 400/56
5,608,430 A * 3/1997 Jones et al. ..... 347/8
5,610,636 A * 3/1997 Hanabusa et al. ..... 347/8

* cited by examiner

*Primary Examiner*—John Barlow
*Assistant Examiner*—Julian D. Huffman

(57) ABSTRACT

An apparatus in a printer for adjusting pen-to-print medium spacing independently of the size of a print medium is disclosed. The apparatus includes a pen, a print platen, a datum, an bar and a means for moving the bar. The print platen supports a print medium for printing using the pen. The datum holds the print platen a first predetermined pen-to-print medium spacing away from the pen. The print platen is resiliently biased against the datum and can be moved away from the datum to define a gap therebetween. The bar is moveable into and out of the gap. When the bar is in the gap, the print platen rests against the bar to define a second predetermined pen-to-print medium spacing. A remotely sent parameter allows the apparatus to make the appropriate adjustment.

12 Claims, 7 Drawing Sheets

APPARATUS FOR CONTROLLING PEN-TO-PRINT MEDIUM SPACING

FIELD OF INVENTION

This invention relates generally to the controlling of pen-to-print medium spacing on a wet ink printer. More particularly, the invention concerns an apparatus for adjusting the pen-to-print medium spacing automatically according to a selected thickness of a print medium.

BACKGROUND

Typically an ink-jet printer, or any printer using wet ink, include a pen (also called a printhead) and a print platen for supporting a print medium for printing with the pen. An area between the pen and the print platen is commonly known as a print zone of the printer. The print platen guides and supports the print medium in the print zone during printing. The printer also includes a print medium feed mechanism for feeding a print medium through the print zone. During printing, ink is placed on the print medium by dropping or ejecting the ink from the pen, or by any other printing method well-known by those skilled in the art. The quality of a printout on the print medium depends on the resolution of the printer. The resolution is defined as the number of drops of ink required to cover a given area. For example, a printer with a 600 dots-per-inch (dpi) resolution is able to print dots of a size of 1/600 of an inch. To achieve higher resolution and thus higher quality printing, it is a constant goal to achieve even smaller dot sizes from the pen. In addition to dot size, it is crucial that the drop be placed accurately on a desired position on the print medium. Inaccuracy in placement will result in a printout that lacks sharpness. Also inaccurate placement of dots will affect the colors of a printout since the colors are obtained by a half-toning process. There are several factors affecting the accuracy of placement of ink drops. These factors include the control of the movement of the pen, the timing of firing pulses applied to the pen and other known factors. One factor affecting placement accuracy is the draft that is created by movement of the pen during printing. To reduce the effect of the draft, a print medium is brought as close to the pen as possible. The distance between the pen and the print platen supporting the print medium is known as the pen-to-print medium spacing or distance. The smaller the pen-to-print medium distance, the less likely printing is affected by the draft. However, there is a limit to this reduction of pen-to-print medium distance. When a print medium is brought too close to the pen, smearing will occur during printing. Ink used in wet ink type printing includes a relatively large amount of water. As the wet ink comes into contact with the print medium, the water in the ink saturate the fibers of the print medium, causing the fibers to expand, which in turn causes the print medium to buckle. Such buckling will cause the print medium to come into contact with the pen during printing. Therefore, some allowance is required to prevent such a buckling print medium from touching the pen. Typically in the production of such printers, the pen-to-print medium distance is calibrated for a commonly used media thickness of for example 0.1 mm. With this media thickness, the printer mechanism is adjusted such that a good quality printout is achieveable. Because of the requirement to support media of different thicknesses, some printers are provided with mechanical levers for a user to manually adjust the pen-to-print medium spacing. Usually two values of pen-to-print medium spacing are provided, one for thinner media and the other for thicker media. One disadvantage of such a system is that the quality of printing is contingent on the user remembering to move the lever to the correct position for a print medium. If the pen-to-print medium spacing is incorrectly set, poor quality printout will result. For example if high pen-to-print medium distance is selected for a thin medium, the earlier mentioned problem of draft will affect the accuracy of the placement of the ink drops. If low pen-to-print medium is selected for a thick medium, smearing may occur. It is therefore important that a user sets the lever to the correct position before commencing printing.

To overcome this problem of a user having to properly set the pen-to-print medium distance, some printers are designed to detect the widths of a print medium and to adjust the pen-to-print medium spacing accordingly. However, such a design is restrictive in the sense that it accepts only certain print media of the appropriate size and thickness.

From the foregoing, the prior art therefore has a need for an improved method and apparatus for adjusting pen-to-print medium spacing which is less error prone and which is able to accept media of different sizes and thicknesses.

SUMMARY

In accordance with a preferred embodiment of the present invention, an apparatus for adjusting a pen-to-print medium spacing in a printer has a pen and a print platen. The print platen supports a print medium for printing using the pen. The apparatus also includes a datum for holding either the pen or the print platen a first predetermined pen-to-print medium spacing away from the other. The pen or print platen is resiliently biased against the datum. The pen or print platen can be moved away from the datum to define a gap therebetween. The apparatus further includes a bar which is moveable into and out of the gap. When the bar is in the gap, the pen or print platen rests against the bar to define a second predetermined pen-to-print medium spacing. The bar is preferably moved by a means which is activated independently of the size of a print medium.

Preferably the means for moving the bar includes a rocker lever which is pivoted to a support. The bar is attached to the rocker lever. The rocker lever can be tilted to an engaged position to place the bar between the datum and the pen or the print platen to define the second predetermined pen-to-print medium spacing. The bar-moving means also includes a gear which is slidably coupled to the rocker lever for rotating the rocker lever when the gear is rotated. This gear can be rotated independently of the rocker lever when the rocker lever is obstructed. Also included in the bar-moving means is an arm which is pivoted and resiliently biased to the rocker lever. The arm has a transverse guide pin. A first blocking tab extends in an opposite direction to the guide pin for holding the guide pin, the arm and the rocker lever to a first retracted position when the gear is rotated in one direction of rotation. A second blocking tab extends in the same direction as the first blocking tab for holding the guide pin, the arm and the rocker lever to a second retracted position when the gear is rotated in an opposite direction of rotation. The first and the second blocking tabs define a gap therebetween for allowing the exit of the guide pin. A third tab also extends in the same direction as the first and second blocking tabs. This third tab is positioned between the first and the second blocking tabs for defining a cyclic path for the guide pin to move between the first retracted position and the second retracted position when the gear is alternatingly rotated a predetermined angular distance in each direction of rotation. To change the pen-to-print medium spacing, the gear is rotated in a predetermined sequence to allow the guide pin to leave the cyclic path via the gap to tilt the rocker lever to the engaged position.

The apparatus allows the pen-to-print medium spacing to be adjusted independently of the size of a print medium. In order for the printer to carry out an adjustment, a parameter indicating the desired pen-to-print medium spacing is remotely sent to the printer.

BRIEF DESCRIPTION OF DRAWINGS

The invention will be better understood with reference to the following drawings, in which.

DETAILED DESCRIPTION OF THE PREFERRED EMBODIMENT

Hereafter, a preferred embodiment of the present invention will be described in the context of an ink jet printer having a pen, a print platen and a clutch mechanism. However, it is to be understood that the invention is usable with any imprinting equipment using a pen or other devices where the pen-to-print medium spacing needs to be adjustable depending on the thickness of a print medium.

Figure 1:
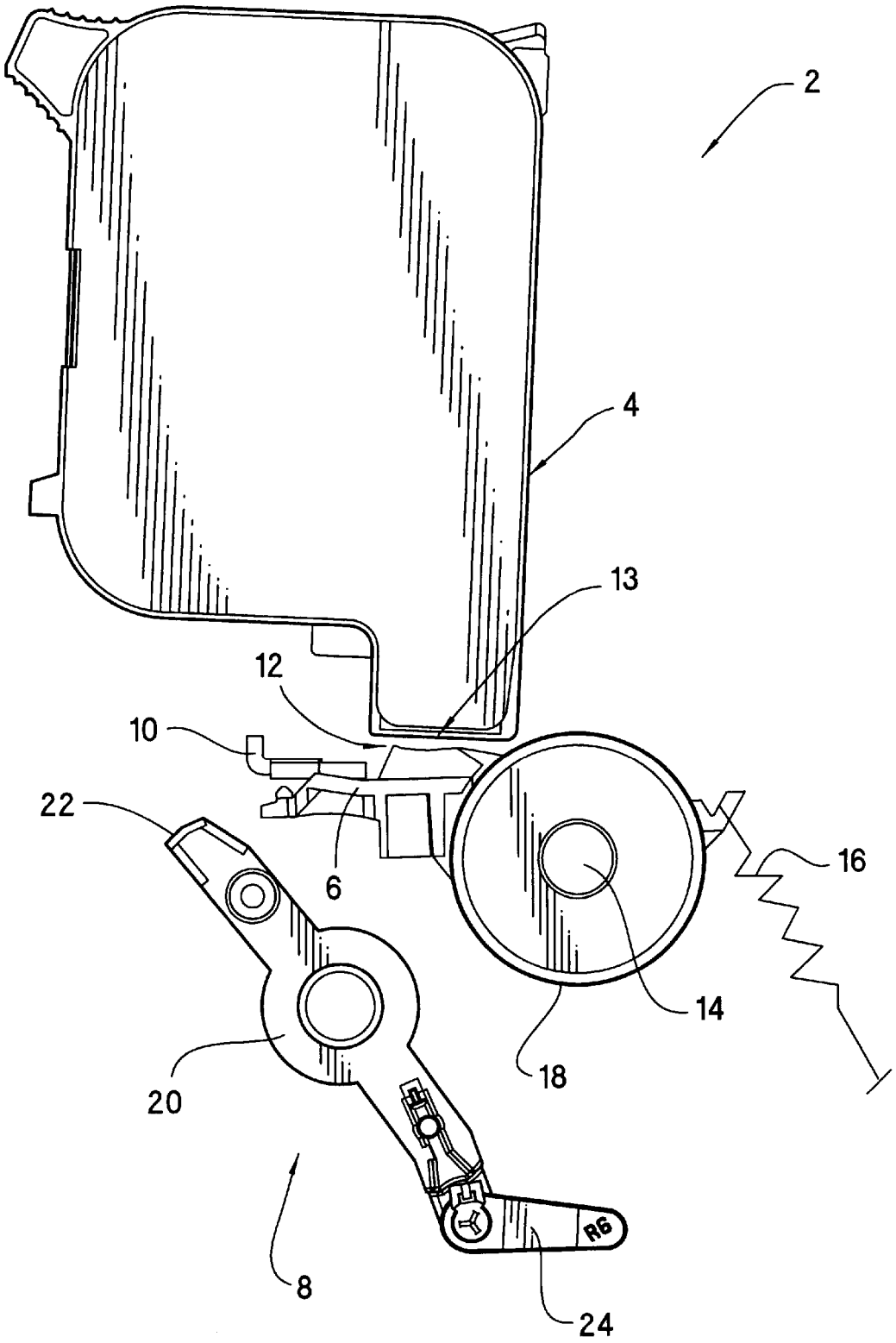
FIG. 1 is a side view of a portion of an ink jet printer showing an apparatus for controlling a pen-to-print medium spacing according to the present invention. The figure shows a print platen, a datum and a gap therebetween which defines the pen-to-print medium spacing. The figure also shows a partial clutch mechanism. This clutch mechanism has a rocker lever with a transverse bar. This rocker lever can be actuated to adjust the pen-to-print medium spacing.

FIG. 1 is a side view of a portion of the ink jet printer 2 showing the pen 4, the print platen 6 and the clutch mechanism 8 according to the present invention. FIG. 1 also shows a datum 10 against which the print platen 6 rests to define a first predetermined pen-to-print medium spacing 12. The area between the pen 4 and the print platen 6 is commonly known as a print zone 13 of a printer. The print platen 6 is pivotably mounted on a drive roller shaft 14 and resiliently biased against the datum 10 by a tensioned spring 16. Rollers 18 mounted on the drive roller shaft 14 transport a print medium to the print zone 13 for printing. Ribs (not shown) on the print platen 6 maintain a print medium substantially flat even though wet ink from the pen 4 causes the print medium to warp. Such flattening of a print medium allows the pen-to-print medium distance to be more easily controlled as compared to a warped print medium.

Figure 3:
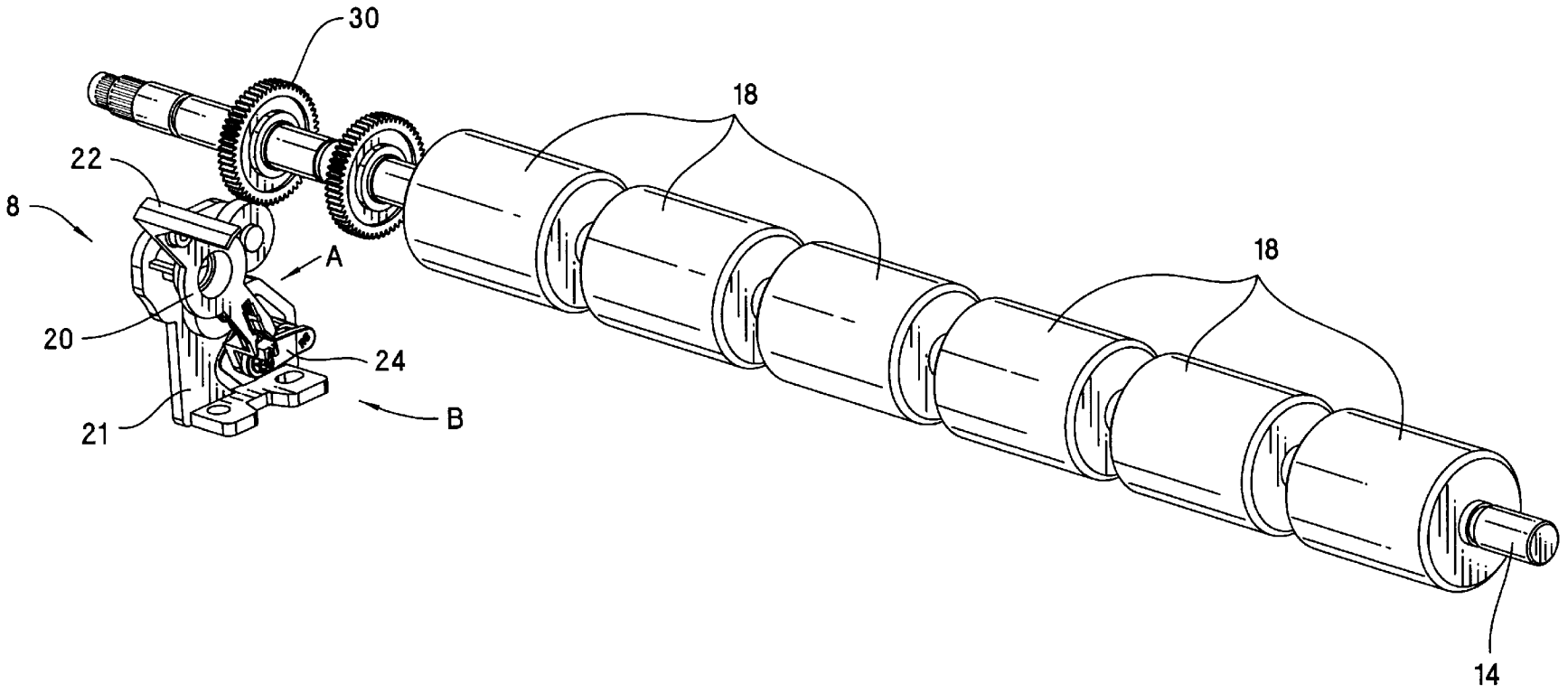
FIG. 3 is an isometric view showing the complete clutch mechanism of FIG. 1. The clutch mechanism includes gears which are driven by a drive gear fixed on a drive roller shaft.
Figure 4:
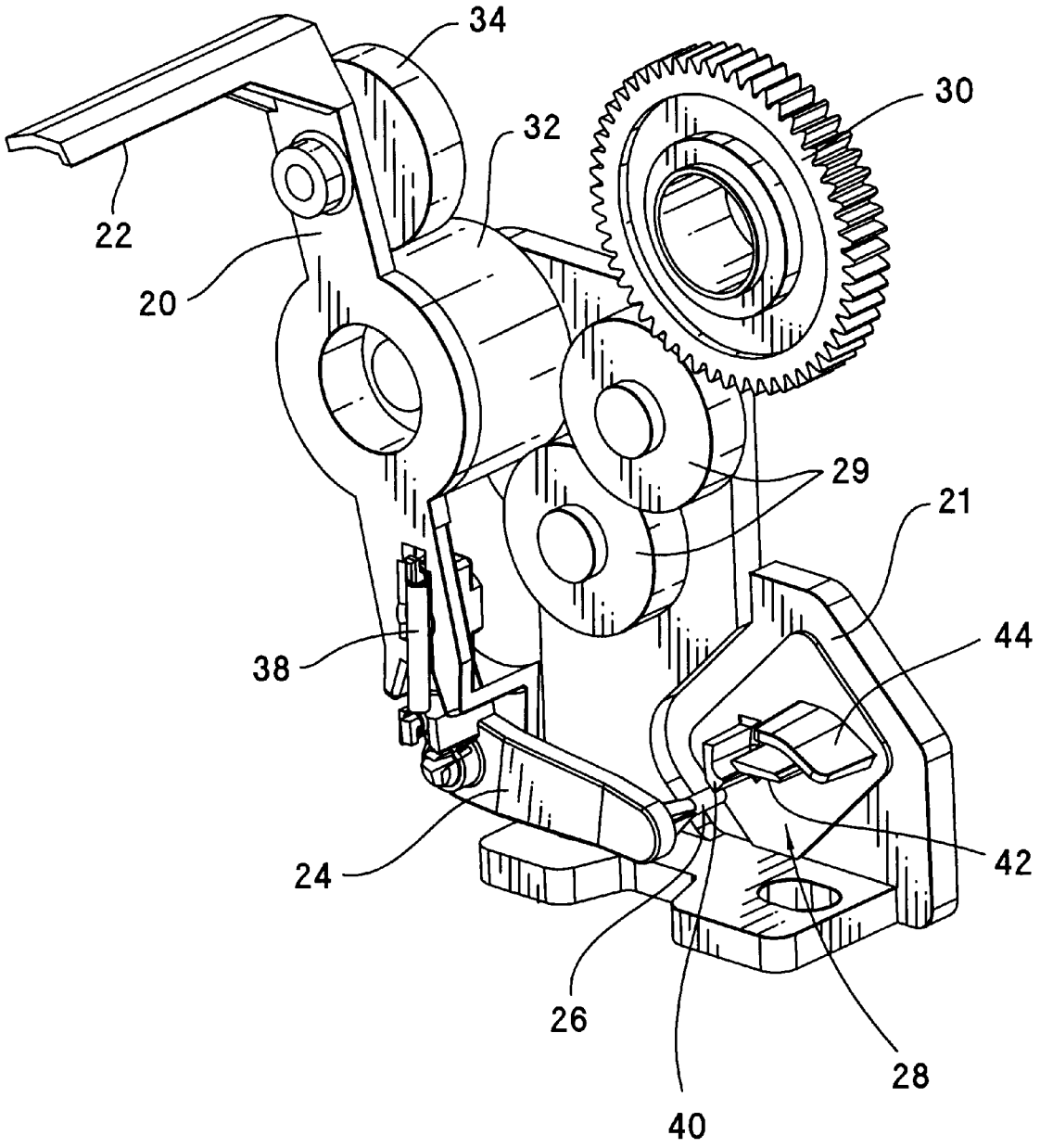
FIG. 4 is an enlarged isometric view of the clutch mechanism of FIG. 3.

The datum 10 is fixed on a chassis (not shown) of the printer. The positioning of the datum 10 on the chassis defines the first pen-to-print medium distance. The clutch mechanism 8 includes a rocker lever 20. This rocker lever 20 is pivotably mounted on a support 21 (FIG. 3) that is fixed on the chassis. On one end of the rocker lever 20 is a transverse bar 22 (FIG. 3) for inserting between the print platen 6 and the datum 10 to define a second larger pen-to-print medium spacing. On the other end of the rocker lever 20 is pivoted a resiliently biased arm 24. Transversely extending from the arm 24 is a guide pin 26 (FIG. 4). A set of tabs 28 (FIG. 4) on the support 21 confines movement of the guide pin 26 within bounds defined by the set of tabs 28. Such confinement of the guide pin 26 restricts the lateral movement of the arm 24 and therefore prevents the rocker lever 20 from tilting sufficiently to change the pen-to-print medium spacing 12.

Figure 2:
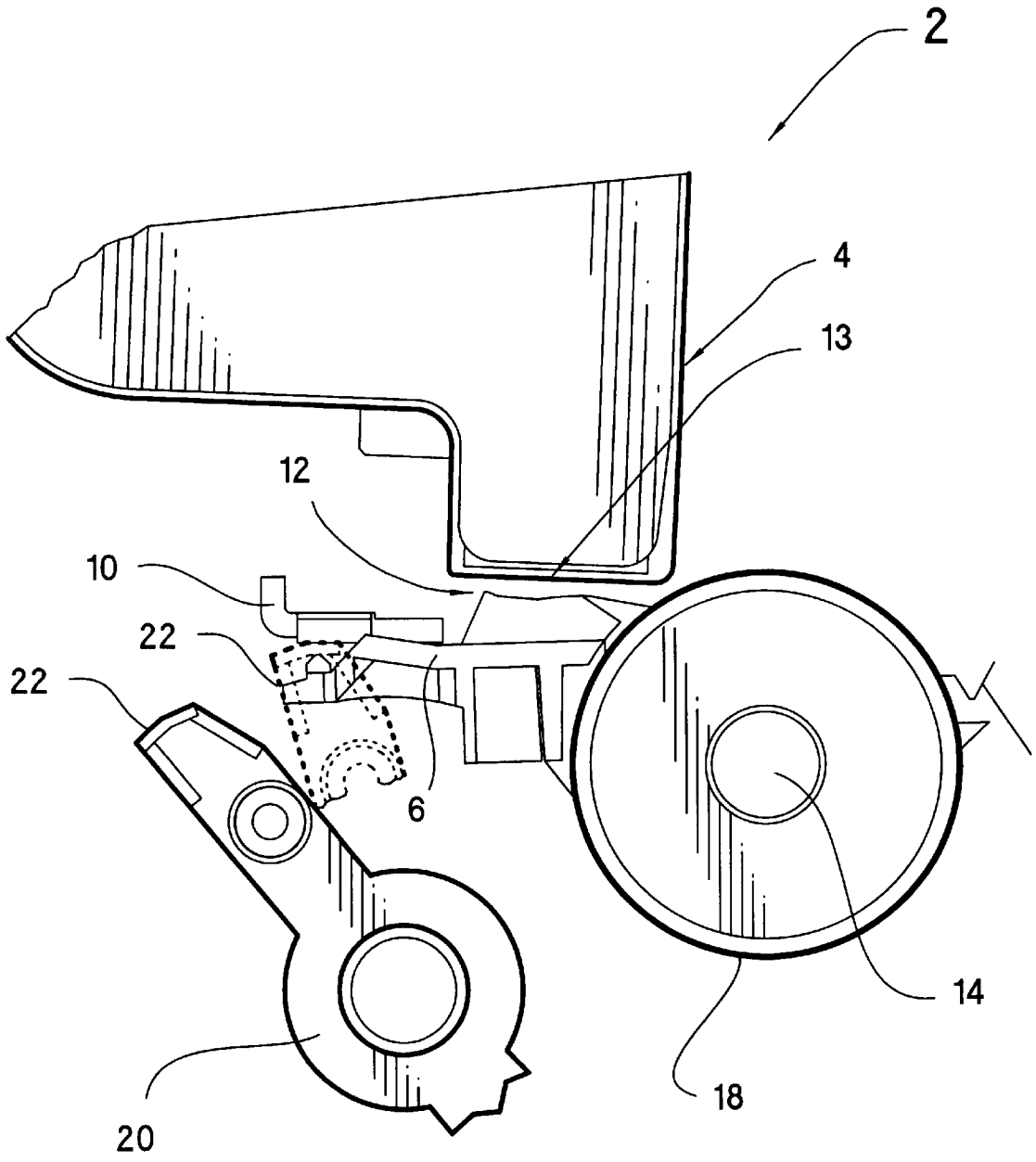
FIG. 2 is a side view similar to FIG. 1 showing the rocker lever actuated with the bar (in broken lines) slotted between the print platen and the datum to define a larger pen-to-print medium spacing.

FIG. 2 is another side view of the portion of the ink jet printer 2. This figure shows the transverse bar 22 (in broken lines) inserted between the print platen 6 and the datum 10 to define the second predetermined pen-to-print medium spacing. FIG. 3 is an isometric view showing the clutch mechanism 8 driven by a gear train 29 which translates rotational movement from a drive gear 30 fixed on the drive roller shaft 14 to tilt the rocker lever 20.

FIG. 4 is an enlarged isometric view of the clutch mechanism 8 in FIG. 3 as seen in the direction of an arrow A in FIG. 3. Axially coupled to and abutting the rocker lever 20 is a gear 32. This coupled gear 32 has a surface which is in slideable contact with the rocker lever 20. The friction between the surfaces of the coupled gear 32 and the rocker lever 20 causes the rocker lever 20 to tilt according to the direction of rotation of the coupled gear 32. Preferably, in meshing configuration with this coupled gear 32 is a biased gear 34. This gear 34 is pivoted to the rocker lever 20 together with a slightly compressed wave washer (not shown). The wave washer urges the gear 34 against the rocker lever 20 to increase torque which is required to move the coupled gear 32 independently of the rocker lever 20. The use of such a biased gear 34 ensures that sufficient friction is present to allow the rocker lever 20 to be tilted with the coupled gear 32. However, such friction should be overcome when the rocker lever 20 is obstructed to allow the coupled gear to rotate independently of the rocker lever 20.

A coil spring 38 which is attached on one end to the rocker lever 20 and on the other end to the arm 24 provides the resilience of the arm 24.

Figure 5A:
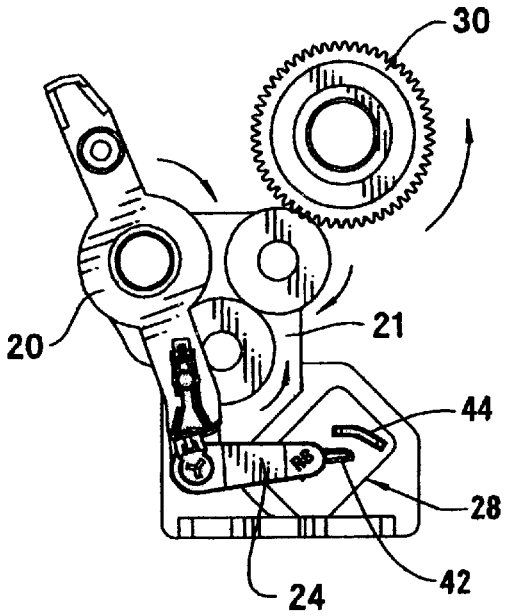
FIGS. 5A, 5B, 5C and 5D are side views of the clutch mechanism in FIG. 3. The rocker lever of the clutch mechanism is shown tilted to different positions by the rotation of the drive roller shaft in FIG. 3.

FIGS. 5A, 5B, 5C and 5D are side views of the clutch mechanism 8 in FIG. 3 viewed in the direction of an arrow B in FIG. 3. The figures show the rocker lever 20 of the clutch mechanism 8 tilted to different positions when the drive roller shaft 14 is rotated. The operation of the clutch mechanism 8 will now be described in terms of direction of rotation of the coupled gear 32. FIG. 5A shows the rocker lever 20 of the clutch mechanism 8 in a home position. In this home position of the rocker lever 20, the clockwise rotation of the coupled gear 32 causes the guide pin 26 to impinge on a lower blocking tab 40. The lower blocking tab 40 prevents the rocker lever 20 from tilting past its home position even as the coupled gear 32 is driven further in the clockwise direction. The coupled gear 32 is driven with sufficient torque to overcome the friction posed by the rocker lever 20 and the biased gear 34 on the coupled gear 32 to allow the coupled gear 32 to rotate independently of the rocker lever 20. In this home position, the rocker lever 20 is not tilted sufficiently to allow the transverse bar 22 to affect the pen-to-print medium spacing. The blocking of the guide pin 26 in such a home position causes the arm 24 to move upwards from its home position in relation to rocker lever 20 to flex the coil spring 38.

Figure 5B:
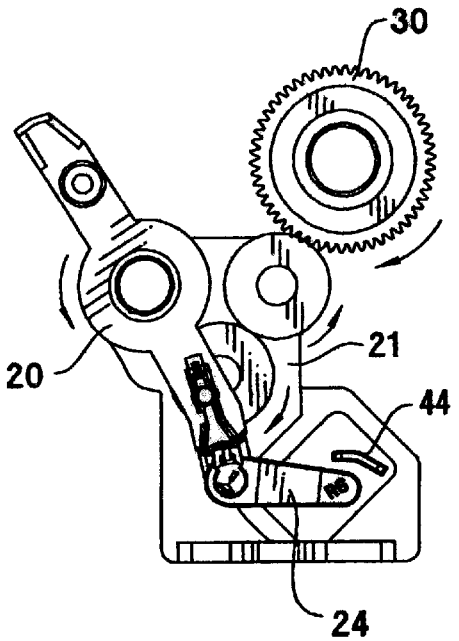
Figure 5C:
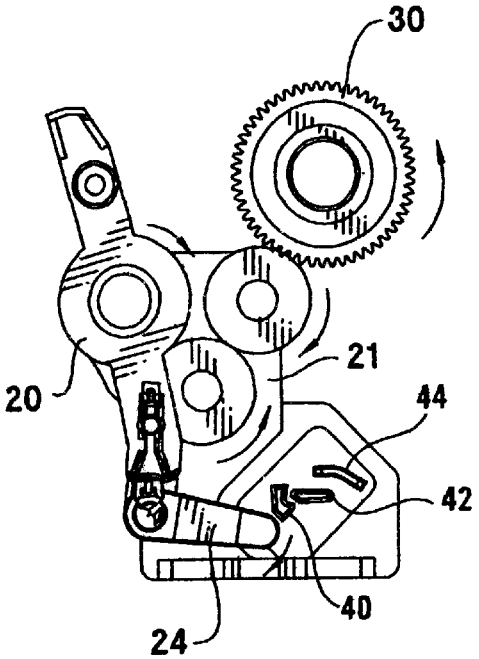

To adjust the pen-to-print medium spacing, the rocker lever 20 is released from the home position. Releasing the rocker lever 20 requires that the coupled gear 32 be driven in an anti-clockwise direction for an angular distance as determined by the shapes and positions of the tabs 28. Since there is no obstruction to the movement of the lever 20, the lever 20 tilts in accordance with the coupled gear 32. Driving the coupled gear 32 for an appropriate angular distance causes the rocker lever 20 to move to an intermediate position as shown in FIG. 5B. In this intermediate position of the rocker lever 20, the guide pin 26 moves along an undersurface of the middle tab 42 towards an upper blocking tab 44. As the rocker lever 20 leaves its home position, the coil spring 38 straightens to return the arm 24 to its home position. The arm 24 in this position allows the guide pin 26 to interact with the middle tab 42 for the guide pin 26 to follow a path along the undersurface of the middle tap 42. The moving of the rocker lever 20 to this intermediate position causes the guide pin 26 to impinge on the undersurface of the middle tab 42 to tilt the arm 24 downwards from its home position and to flex the coil spring 38. Before the coupled gear 32 is driven further in the anti-clockwise direction to allow the guide pin 26 to move past the middle tab 42, the coupled gear 32 is driven again in the clockwise direction. Such a sequence allows the rocker lever 20 to be tilted until the bar 22 is inserted in place between the datum 10 and the print platen 6. In this position, the rocker lever 20 is in its released position. FIG. 5C shows the rocker lever 20 in this released position.

If however, the coupled gear 32 is driven in the anti-clockwise direction sufficiently to allow the guide pin 26 to go beyond the edge of the middle tab 42, the flexed coil spring 38 would straighten to return the arm 24 to its home position. The arm 24 in this home position interacts with the middle tab 42 to allow the guide pin 26 to impinge on the top surface of the middle tab 42 when the coupled gear 32 is driven in the clockwise direction. The middle tab 42 and resilient arm 24 therefore allows the guide pin 26 to traverse a cyclic path around the middle tab 42 when the coupled gear 32 is driven in alternating directions for substantial angular distances. The upper and lower tabs 40, 44 define the limits of movement of the guide pin 26. When the guide pin 26 is in this cyclic path, the rocker lever 20 is in its retracted positions, and the pen-to-print medium spacing is maintained at the first predetermined value. The only way to change the pen-to-print medium spacing to the second predetermined value is to release the rocker lever 20 by driving the coupled gear 32 in the predetermined sequence as described. As it is common for a printer with a single motor to be driven substantially either in one or both directions for one or more complete revolutions, the predetermined sequence can be easily accommodated in such a printer for activating the rocker lever 20 without disrupting the printer's other operations.

Figure 6:
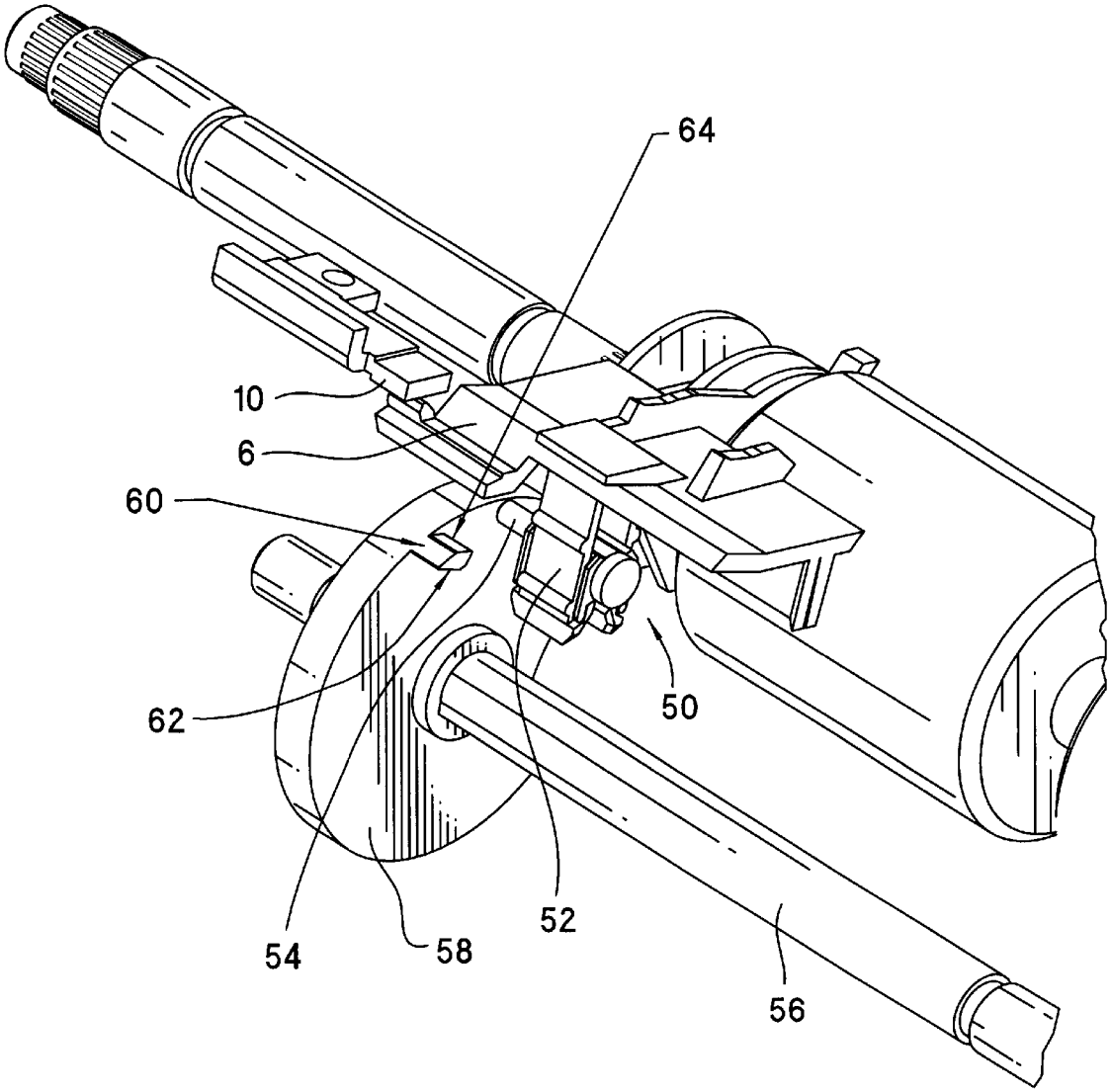
FIG. 6 is an isometric view showing the datum and print platen in FIG. 1. The figure also shows a latching member attached to the print platen for unidirectional movement of the print platen to allow the bar on the rocker lever to be moved into place to increase the pen-to-print medium spacing.

The description has so far been focused on the activation of the rocker lever 20. To allow the bar 22 on the rocker lever 20 to be inserted in place between the datum 10 and the print platen 6, the print platen 6 has to be moved away from the datum 10. This synchronized moving of the print platen 6 is now described. FIG. 6 is an isometric view showing the datum 10 and print platen 6. The figure also shows a latching member 50 fixed to the print platen 6 for downward movement of the print platen 6 to allow the bar 22 to be moved into place to increase the pen-to-print medium spacing. The latching member 50 has a guide 52 which is fixed at one end to the print platen 6. The latching member 50 also has a spring (not shown) and a latching pin 54 within the guide 52. The spring urges the latching pin 54 against the end of the guide distal from the print platen 6. The spring is compressible to allow the latching pin 54 to be pushed within the guide 52 in the direction of the print platen 6 without moving the print platen 6.

Figure 7:
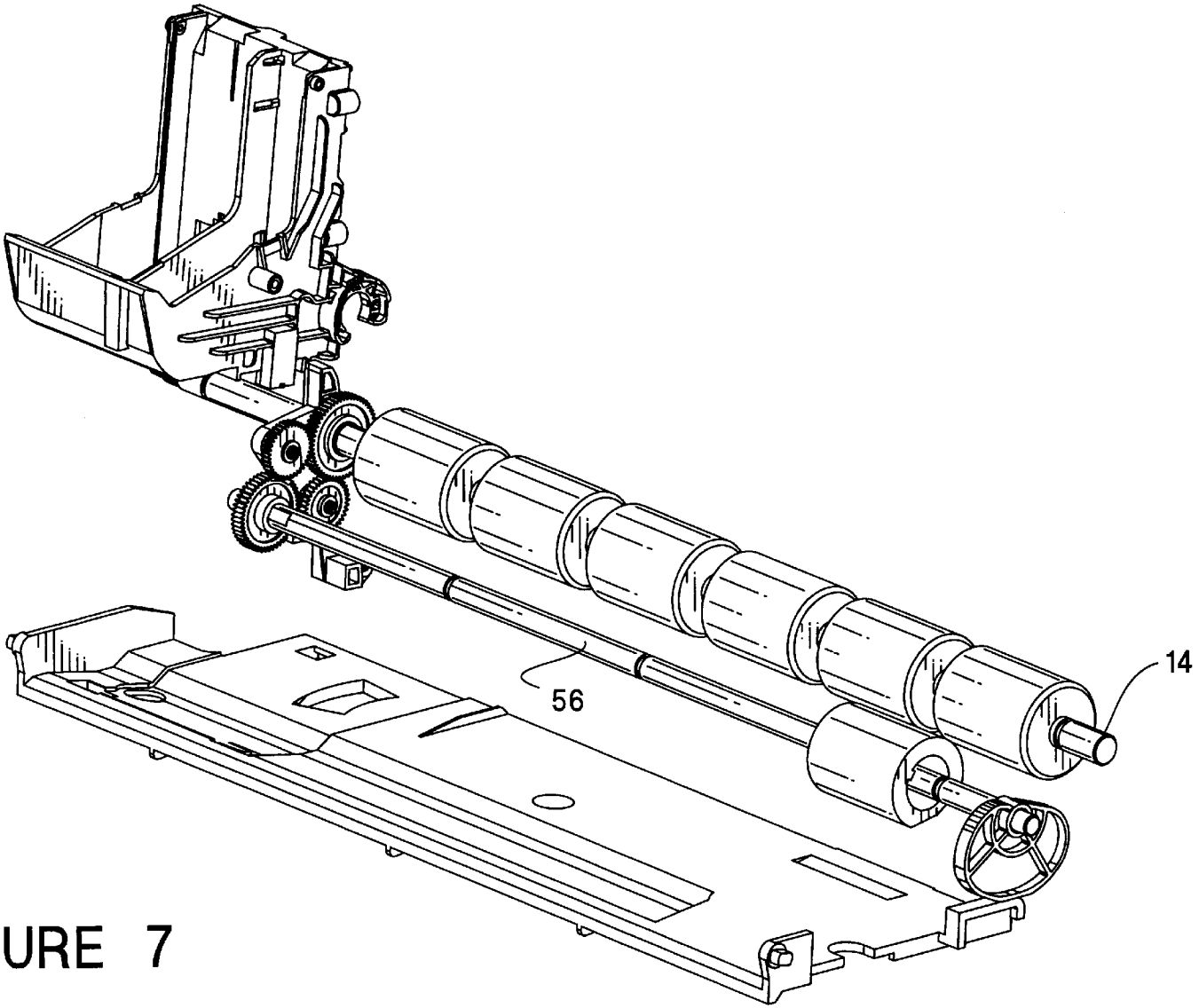
FIG. 7 is an isometric view of a pick roller shaft and a drive roller shaft driven by a single motor. The apparatus according to the present invention can be incorporated into a printer using these shafts.

On a second shaft 56 is mounted a plate 58. On the periphery of the plate 58 is a ramp member 60. This ramp member 60 has a forward ramp 62 and a reverse ramp 64. The second shaft 56 preferably draws its movement from the same motor as the drive roller shaft 14. In this preferred embodiment, the second shaft 56 is preferably a pick roller shaft for picking a new medium. FIG. 7 is an isometric view showing such a pick roller shaft 56 driven by a same motor as the drive roller shaft 14. As the drive roller shaft 14 is rotated to tilt the rocker lever 20 for changing the pen-to-print medium spacing, the plate 58 is synchronously rotated to allow the forward ramp 62 to engage the latching pin 54 for pulling the latching pin 54 downwards. The downward pushing of the pin 54 brings the print platen 6 downwards away from the datum 10 to define a gap therebetween to receive the bar 22 on the rocker lever 20. As the plate is rotated, the ramp member 60 slides past the latching pin 54 to allow the biased print platen 6 to be returned towards the datum 10. With the bar 22 moved to its engaged position between the print platen 6 and the datum 10, the print platen 6 on returning to its position adjacent the datum 10 will come to rest against the bar 22. The thickness of the bar 22 determines the second predetermined pen-to-print medium spacing.

Figure 5D:
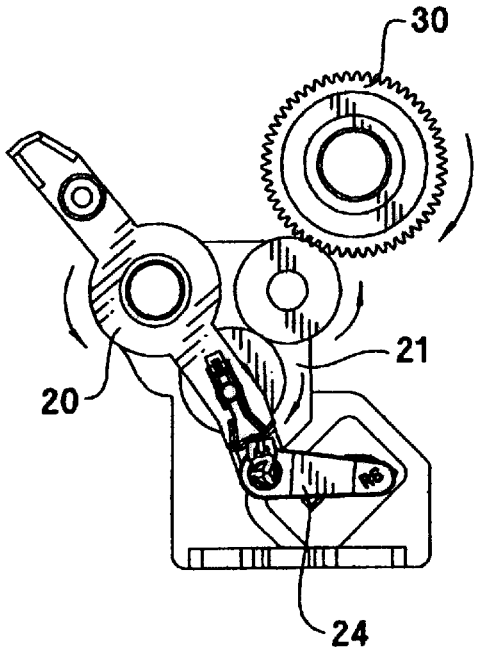

To change the pen-to-print medium spacing from the second to the first predetermined value, the plate 58 is rotated an entire revolution to again allow the forward ramp 62 to engage the latching pin 54 to pull the print platen 6 down. In this position of the print platen, the coupled gear 32 is driven in an anti-clockwise direction to tilt the rocker lever 20 away from the gap between the datum 10 and print platen 6. The guide pin 26 will move to the intermediate position and will impinge on the undersurface of the middle tab 42 and end up locked against the upper tab 44 as previously described. When the guide pin 26 is in this position, the rocker lever is in a retracted position. FIG. 5D shows the lever in the retracted position. Further anti-clockwise rotation of the coupled gear 32 will not affect the position of the rocker lever 20.

As can be seen from the above description, the rocker lever 20 may be in any position at any one time. In the event of a power up when the position of the rocker lever 20 is unknown, the drive roller shaft 14 is rotated to cause the coupled gear 32 to rotate in an anti-clockwise direction to bring the rocker lever 20 to the retracted position. And as the drive roller shaft 14 is rotated forward to pick up a new print medium for printing, the coupled gear 32 will be rotated to tilt the rocker lever 20 to its home position with the guide pin 26 impinging on the lower tab 40.

With the above-described apparatus for adjusting the pen-to-print medium spacing on a printer, there is no necessity for any manual adjustment to be made on the printer to change the pen-to-print medium spacing. A remotely sent parameter relating to the thickness of a selected print medium would suffice for the printer to perform the necessary adjustment. This parameter can be sent to the printer along with other details of a printjob.

We claim:

1. Apparatus for adjusting pen-to-print medium spacing in a printer comprising:

a fixed datum;

a print platen for supporting a print medium for printing by a pen moveable across the print medium, the print platen being resiliently biased towards the datum to come to rest in a first position where the print platen rests directly against the datum to define a first predetermined pen-to-print medium spacing between the pen and the print platen, the print platen being moveable away from the datum to define a gap therebetween; and a separator movable between an unused position away from the gap and an engaged position in the gap for allowing the print platen to alternatively rest against to prevent it returning to the first position to thereby define a second predetermined pen-to-print medium spacing;

wherein the platen and the separator are operable according to a remote medium thickness parameter received by the printer.

2. The apparatus according to claim 1, further including:

a pivotably mounted lever that supports the separator; and a gear frictionally coupled to the lever for tilting the lever to move the separator between the unused and the engaged positions.

3. The apparatus according to claim 2, further including a motor which is driven to rotate the gear.

4. The apparatus according to claim 3, further including:

a restricting means for releasably holding the lever to prevent the lever tilting to the engaged position;

a pick roller shaft coupled to the print platen, the pick roller shaft being rotatable in a first direction by the motor for picking a print medium and for moving the the print platen away from the first position during a pick cycle;

a drive roller shaft that is rotatable by the motor in the first direction for advancing the picked print medium between the print platen and the pen;

whereby before printing on the print medium begins, the drive roller shaft is rotatable for a first angular distance in an opposite direction to the first direction and then in the first direction again to continue to advance the picked medium and to release the lever from the restricting means to allow the lever to tilt to move the separator to the engaged position.

5. The apparatus according to claim 4, wherein moving the separator to the unused position involves rotating the drive roller shaft in the opposite direction before printing begins for a second larger predetermined angular distance to tilt the lever to move the separator to the unused position and to allow the restricting means to hold the lever when the drive roller is subsequently rotated in the first direction to continue to advance the print medium.

6. Apparatus for adjusting pen-to-print medium spacing in a printer comprising:

a fixed datum supported by a support;

a print platen for supporting a print medium for printing by a pen moveable across the print medium, the print platen being resiliently biased towards the datum to come to rest in a first position where the print platen rests directly against the datum to define a first predetermined pen-to-print medium spacing between the pen and the print platen, the print platen being moveable away from the datum to define a gap therebetween;

a rocker lever pivotably mounted on the support and having a transverse bar, the rocker lever being tiltable between an unused position where the bar is kept away from the gap and an engaged position where the bar is moved into the gap for allowing the print platen to alternatively rest against to prevent it returning to the first position to thereby define a second pen-to-print medium spacing;

a first gear in frictional abutment with the rocker lever, the rotation of the first gear rotates the rocker lever if the rocker arm is unobstructed and rotates independently of the rocker lever when the rocker lever is obstructed, the first gear being rotated in a first and a second direction to tilt the rocker lever to the unused and the engaged positions respectively;

a retaining arm pivotably mounted on and resiliently biased to the rocker lever, the arm having a transverse guide pin;

first, second, and third blocking tabs which extend from the support in an opposite direction to the guide pin, the third blocking tab being positioned between the first and the second blocking tabs, the first and the second blocking tabs defining a gap adjacent the third blocking tab;

wherein in use the first blocking tab and the second blocking tabs limit the movement of the guide pin between a first retracted position and a second retracted position respectively when the first gear is rotated in the first and second directions to bring the guide pin from one of the first and the second retracted positions to the other along a cyclic path around the third blocking tab, the rocker lever being held in the unused position when movement of the guide pin is restricted to the cyclic path, and wherein when the guide pin is in the first retracted position, the first gear is rotatable in the first direction for a predetermined angular distance to bring the guide pin to a position between the first and the second retracted positions to be adjacent the gap and subsequent rotation of the first gear in the second direction allows the guide pin to leave the cyclic path via the gap to allow the first gear to tilt the rocker lever to the engaged position.

7. The apparatus according to claim 6, further including a second gear pivotably mounted on the rocker lever and in meshing configuration with the first gear, the second gear being biased to allow the rocker lever to be tilted when the first gear is rotated.

8. The apparatus according to claim 6, wherein the first gear is rotatable by a motor that drives a drive roller of the printer for advancing the print medium.

9. The apparatus according to claim 6, further including a rotary plate having a ramp member, wherein in use the rotary plate is rotatable to allow the ramp member to engage a latching member of the print platen to thereby move the print platen away from the datum.

10. The apparatus according to claim 9, wherein the latching member includes:

a support having a proximal end and a distal end, the support being attached to the print platen at the proximal end;

a latching pin biased against the distal end of the support and slidable in the direction of the proximal end;

and wherein the ramp member includes:

a first ramp for engaging the latching pin to move the print platen when the rotary plate is rotated in one direction; and a second ramp for pushing the latching pin towards the proximal end of the support when the rotary plate is rotated in the other direction.

11. The apparatus according to claim 6; further including: a controller board responsive to a medium thickness parameter by adjusting the pen-to-print medium spacing accordingly.

12. Apparatus for adjusting pen-to-print medium spacing in a printer comprising:

a fixed datum;

a print platen for supporting a print medium for printing by a pen moveable across the print medium, the print platen being resiliently biased directly against the datum to define a pen-to-print medium spacing between the pen and the print platen, the print platen being moveable away from the datum to define a gap therebetween; and a separator movable between an unused position away from the gap and an engaged position in the gap for allowing the print platen to alternatively rest against to change the pen-to-print medium spacing;

wherein the platen and the separator are operable according to a medium thickness parameter received by the printer.

* * * * *